US006896150B2

(12) United States Patent
Schwarzli

(10) Patent No.: US 6,896,150 B2
(45) Date of Patent: May 24, 2005

(54) SECURING SYSTEM FOR A VENDING MACHINE ISLAND

(75) Inventor: Josef W. Schwarzli, Stouffville (CA)

(73) Assignee: Beaver Machine Corporation, Newmarket (CA)

( * ) Notice: Subject to any disclaimer, the term of this patent is extended or adjusted under 35 U.S.C. 154(b) by 46 days.

(21) Appl. No.: 10/359,156

(22) Filed: Feb. 6, 2003

(65) Prior Publication Data

US 2003/0173374 A1 Sep. 18, 2003

(30) Foreign Application Priority Data

Mar. 15, 2002 (CA) ..... 2376925

(51) Int. Cl.[7] ..... B65H 3/44

(52) U.S. Cl. ..... 221/131; 221/263; 221/264; 221/268

(58) Field of Search ..... 221/93, 154, 92, 221/123, 155, 284, 282, 263, 264, 268, 131, 124, 285; 248/176.3, 27.8, 518, 519, 121, 125.1, 176.1, 176.2, 688–691

(56) References Cited

U.S. PATENT DOCUMENTS 2,867,487 A * 1/1959 Kirkpatrick ..... 312/42
3,010,606 A * 11/1961 Heselov ..... 221/92
3,351,233 A * 11/1967 Chanoch et al. ..... 221/150 HC
3,359,993 A * 12/1967 Perdue et al. ..... 453/17
3,390,753 A * 7/1968 Bolen et al. ..... 194/350
3,410,385 A * 11/1968 Freet et al. ..... 194/232
4,498,603 A * 2/1985 Wittenborg ..... 221/76
5,123,551 A * 6/1992 King ..... 221/34
5,505,333 A * 4/1996 Shibazaki et al. ..... 221/155
5,516,003 A * 5/1996 Hebert ..... 221/130
5,651,476 A * 7/1997 Percy et al. ..... 221/131
5,836,476 A * 11/1998 Ampofo ..... 221/131
6,050,447 A * 4/2000 Kovens et al. ..... 221/125
6,182,861 B1 * 2/2001 Kovens et al. ..... 221/258
6,691,897 B2 * 2/2004 Ashe ..... 222/174
6,732,884 B2 * 5/2004 Topliffe et al. ..... 221/3

* cited by examiner

*Primary Examiner*—Kathy Matecki
*Assistant Examiner*—Rashmi Sharma
(74) *Attorney, Agent, or Firm*—Dimock Stratton LLP; Mark B. Eisen

(57) ABSTRACT

In a vending machine island having a standard supporting a mounting plate at an elevated position, a securing post which extends to a level of the top of the tallest vender. A lid locked to the vender is provided with engaging means which engages a bracket affixed to the securing post. The bracket is secured by a locking screw which can only be accessed when the globe is removed, which requires that the lid of the globe be removed. Each vending machine is thus affixed to the stand by both its base and its lid, rendering the vending machine island substantially more resistant to theft and vandalism.

21 Claims, 5 Drawing Sheets

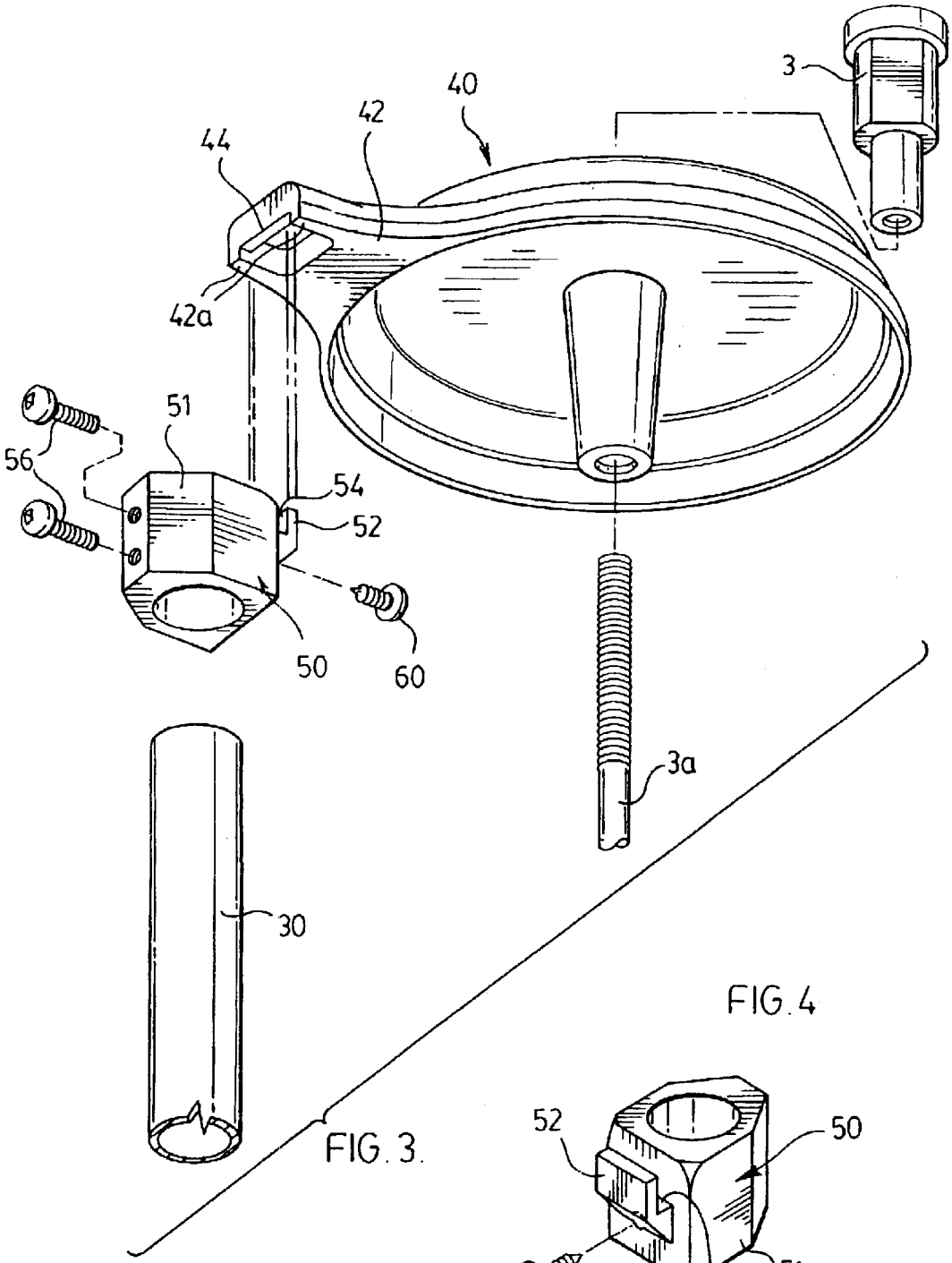
FIG. 3.
FIG. 4
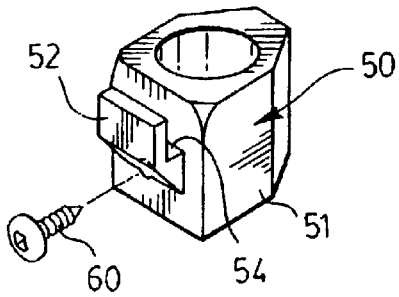

SECURING SYSTEM FOR A VENDING MACHINE ISLAND

FIELD OF THE INVENTION

This invention relates to vending machines. In particular, this invention relates to vending machines mounted to a common stand to form an island.

BACKGROUND OF THE INVENTION

Bulk venders, colloquially known as "gum ball machines", are widely used for dispensing confectioneries and other small articles of merchandise. A typical bulk vender has a hopper assembly comprising a transparent globe which functions as a merchandise storage bin, seated over a dispensing wheel that revolves in a hopper. A patron deposits the required coinage into the coin mechanism and turns the handle, which rotates the dispensing wheel to convey a preset amount of merchandise to the dispensing chute. The hopper assembly is located over a body which is mounted on a base, defining a secure compartment containing a cash box into which the coin mechanism ejects the deposited coins. Bulk vendors of this type are well known to those skilled in the art.

Bulk venders are designed for use in unsupervised public areas, and as such must be resistant to tampering, theft and vandalism by patrons. Frequently bulk vendors are assembled into an "island" formation, in which a plurality of venders are mounted to a common stand, allowing for a variety of merchandise to be dispensed from the same location while providing an organized and aesthetically pleasing vending area. However, vending machine islands can be particularly vulnerable to vandalism and theft. Sometimes an individual will try to damage a vender or remove a vender from the island by wresting the vender, to bend or break the mounting plate to which the vender is bolted.

This presents a problem, because the vender is mounted to the stand solely at the vendor's base, which is typically bolted to the mounting plate. The mounting plate is in turn welded or otherwise affixed to a standard such as a post or pipe. Thus, an individual grasping the globe of the vender has substantial leverage, and can apply a significant amount of torque against the mounting plate and the standard itself. Even where the mounting plate is formed from relatively thick steel plate, a single individual availing himself of the mechanical advantage provided by the height of the bulk vender can significantly deform the stand, or even tear the mounting plate completely from the stand and abscond with the bulk vender. This can have considerable cost consequences to the vending machine operator, in the value of both the lost vender and the lost proceeds from the sale of merchandise.

SUMMARY OF THE INVENTION

The present invention addresses these disadvantages by providing a vending machine island, comprising a plurality of bulk venders mounted to a stand, in which the venders are mounted to the stand at both the base and at the top of each vender. This eliminates the mechanical advantage available to a potential vandal or thief, rendering the vending machine island substantially less vulnerable to vandalism and the bulk venders themselves less vulnerable to theft.

The invention accomplishes this by providing at least one standard supporting at least one mounting plate at an elevated position, and affixed to the stand a securing post which extends to at least a level of the top of the tallest vender. A lid for closing the merchandise storage compartment is provided with engaging means, which engages a bracket affixed to the securing post when the lid is locked to the vender. In the preferred embodiment, a plurality of bulk venders are arranged around the post, the lid of each vender being releasably engaged to the securing post in this fashion. Each vending machine is thus affixed to the stand by both its base and its lid, rendering the vending machine island substantially more vandal resistant.

The present invention thus provides, in a vending machine island comprising a plurality of vending machines, a securing system comprising: a stand having a plurality of mounting positions, a securing post disposed between the mounting positions, engaging means associated with the securing post, and engaging means associated with lids of the plurality of vending machines, adapted to engage the engaging means associated with the securing post, whereby each of a plurality of vending machines mounted to the mounting positions is engaged to the stand at a base of the vending machine and is engaged to the securing post by the lid of the vending machine.

The present invention further provides a vending machine island comprising a plurality of vending machines having lids, and a securing system comprising: a stand having a plurality of mounting positions, a securing post disposed between the mounting positions, engaging means associated with the securing post, and engaging means associated with the lids of the plurality of vending machines, adapted to engage the engaging means associated with the securing post, whereby each of the vending machines mounted to the mounting positions is engaged to the stand at a base of the vending machine and is engaged to the securing post by the lid of the vending machine.

BRIEF DESCRIPTION OF THE DRAWINGS

In drawings which illustrate by way of example only a preferred embodiment of the invention, FIG. 3 is an exploded view of the engaging means in the vending machine island of FIG. 1, FIG. 4 is a perspective view of the engaging bracket of FIG. 3.

DETAILED DESCRIPTION OF THE INVENTION

Figure 1:
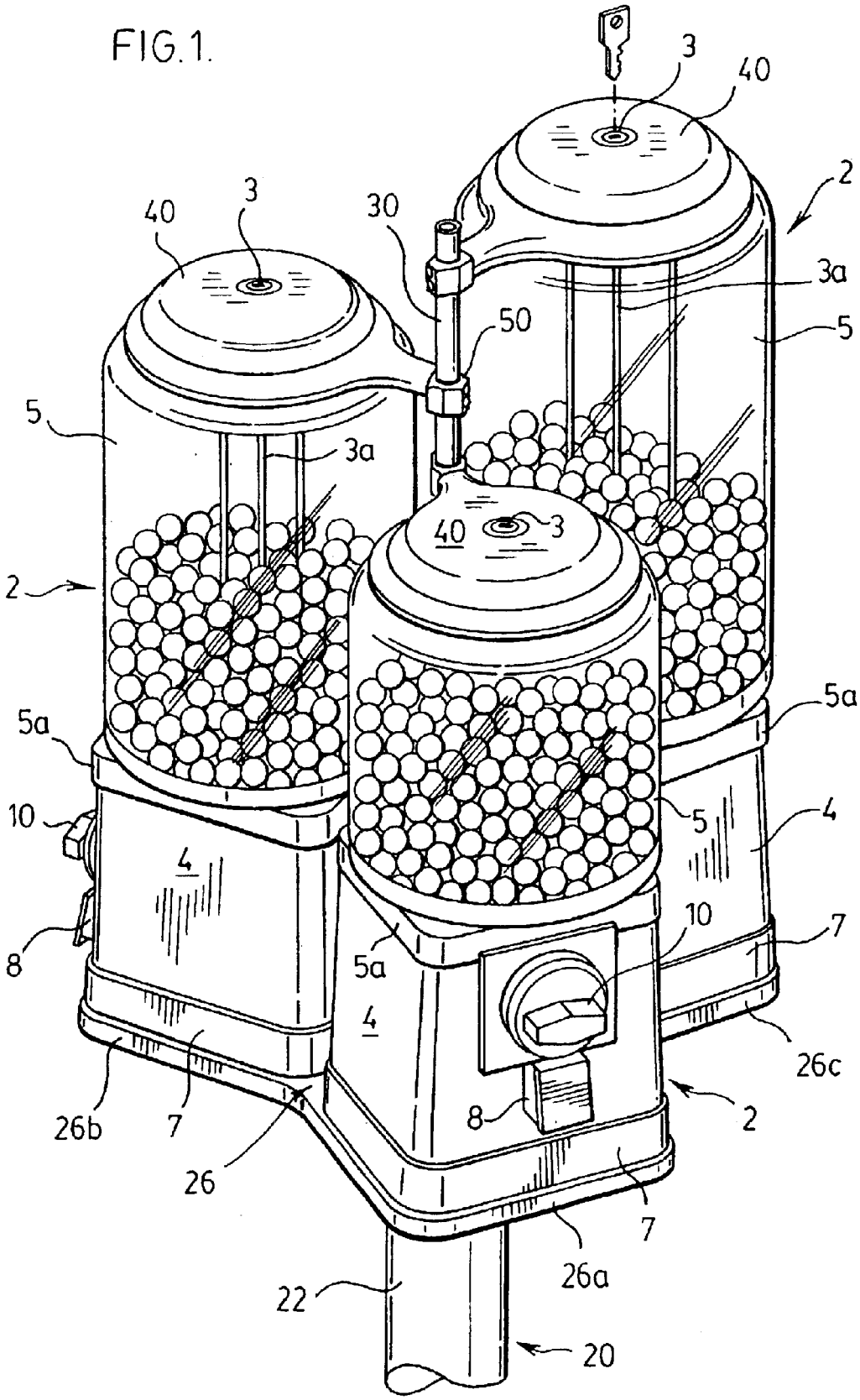
FIG. 1 is a perspective view of a vending machine island according to the invention.

FIG. 1 illustrates a first preferred embodiment of a vending machine island according to the invention. The vending machine island contains a plurality of vending machines 2, each of which may comprise a merchandise storage bin or "globe" 5 seated over a hopper 5*a* containing a dispensing wheel (not shown) which dispenses merchandise through a dispensing chute 8 with each rotation of the coin mechanism 10, as is conventional. Coins fall into a secure compartment 4 disposed above the base 7, and are periodically collected by the vending machine operator by removing the hopper assembly (globe 5 and hopper 5*a*) to expose the secure compartment 4.

The bulk venders 2 are disposed on a stand 20, typically comprising a base (not shown) of any suitable shape supporting at least one standard 22, which in turn supports a mounting plate 26. In the preferred embodiment the mounting plate 26 comprises a plurality of mounting positions or sections 26*a*, 26*b*, and 26*c*, one for each bulk vender 2. The base 7 of each vender 2 will be secured to one mounting section 26*a*, 26*b* or 26*c*, for example bolted.

A securing post 30 is provided for securing the tops of the venders 2 against lateral movement. The securing post 30 is affixed in any desired fashion to the stand 20, for example to the mounting plate 26 or to the standard 22, so that it is rigid and secure and preferably rises substantially vertically between the venders 2.

The merchandise storage bin 5 of each vender 2 is closed off by a lid 40, which is clamped into place by a lock 3 secured to a central support post 3*a* that extends through the vender 2, as can be seen in FIG. 1. The support post 3*a* is anchored to a structurally secure component within the vender, for example to the base 7, as is conventional. According to the invention, the lid 40 is provided with an extension 42, which is preferably integrally formed (for example cast) with the lid 40. The extension 42 may have any desired shape, and terminates in engaging means for engaging the lid 40 to the securing post 30. In the preferred embodiment, the engaging means comprises a flange 44 directed downwardly, seen in FIGS. 8 and 9, which is the direction in which the lid 40 is placed on the vender 2.

The lid engaging means 44 is adapted to cooperate with engaging means locked to the securing post 30, which in the preferred embodiment comprises a bracket 50 having at least one tab 52 forming a slot or channel 54 complimentary to the flange 44. The bracket 50 may have a single channel 54, as in the embodiment of FIG. 4, which is suitable for the island illustrated in FIG. 1 in which the top of each vender 2 is at a different level, and therefore a separate bracket 50 is required to engage each lid 40. The bracket 50 may alternatively have a plurality of channels 54, as in the embodiment shown in FIG. 6, which is suitable for the island illustrated in FIG. 2 in which the top of each vender 2 is at the same level and therefore a single bracket 50 can be used to engage each lid 40, in the manner described below. In either case, it can be seen that the lid extension 42 has a length selected so that the flange 44 engages with the channel 54 when the lid 40 is locked on the vender 2.

Figure 5:
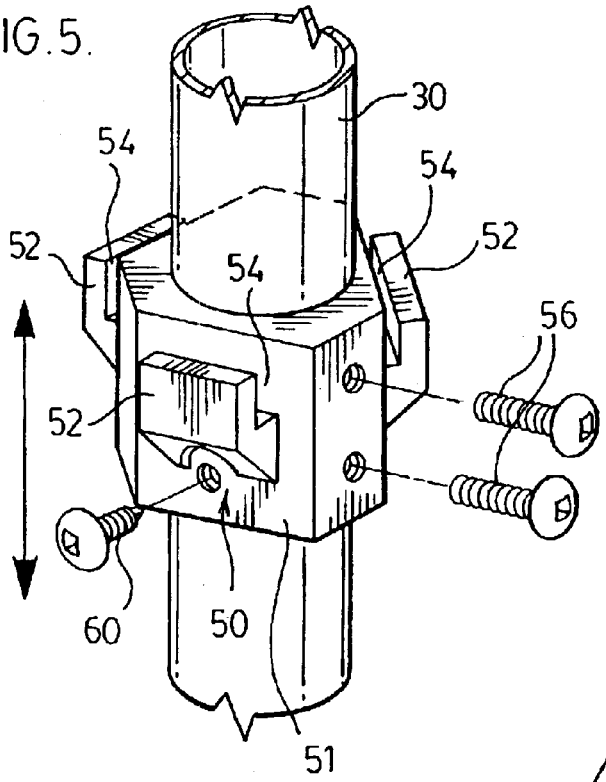
FIG. 5 is a perspective view of an engaging bracket for the vending machine island of FIG. 2.
Figure 7:
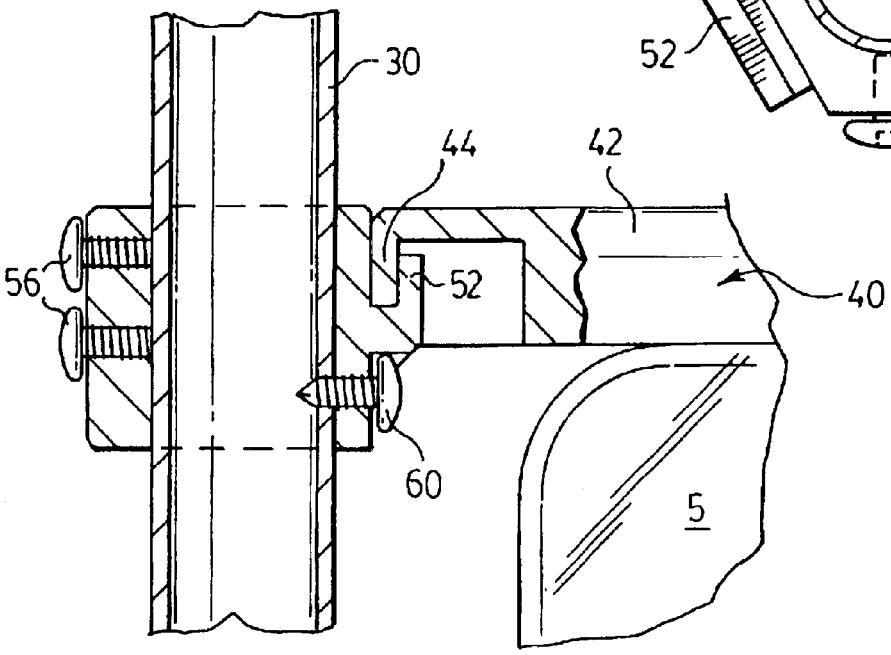
FIG. 7 is a cross-sectional elevation of the engaging bracket of FIG. 3 in the locked position.

The bracket 50 further includes means for engaging the bracket 50 the post 30, which in the preferred embodiment comprises a plurality of screws 56, 60, best seen in FIGS. 5 and 7. The screws comprise at least one setting screw 56 (two are shown in the illustrated embodiment) threadedly engaged through the body 51 of the bracket 50 in a position which is accessible when the vender 2 is seated on the mounting plate 26; and at least one locking screw 60 which is threadedly engaged through the body 51 of the bracket 50 in a position where it is not accessible when the vender 2 is seated on the mounting plate 26. For example, in the embodiment shown in FIGS. 3 and 4 the locking screw 60 is disposed immediately beneath the channel 54, which is obstructed by the globe 5 when the vender 2 is mounted on the mounting plate 26.

In use, the securing post 30 is assembled to the stand 20 in any suitable fashion, and the mounting plate 26 is mounted on top of the standard 22, for example bolted, welded or otherwise affixed. The securing post 30 may be affixed to the mounting plate 26 or to the standard 22 or base (not shown) of the stand. The manner in which the securing post 30 is affixed to the stand 20 is a matter of choice, or the securing post 30 can alternatively be formed integrally with the standard 22, and the invention is not limited thereby. In a further embodiment (not shown) the securing post 30 need not be affixed to the stand 20, but can be retained in position by its engagement to the venders 2; however, it is more secure, and therefore preferable, to have the securing post 30 affixed to the stand 20.

Figure 2:
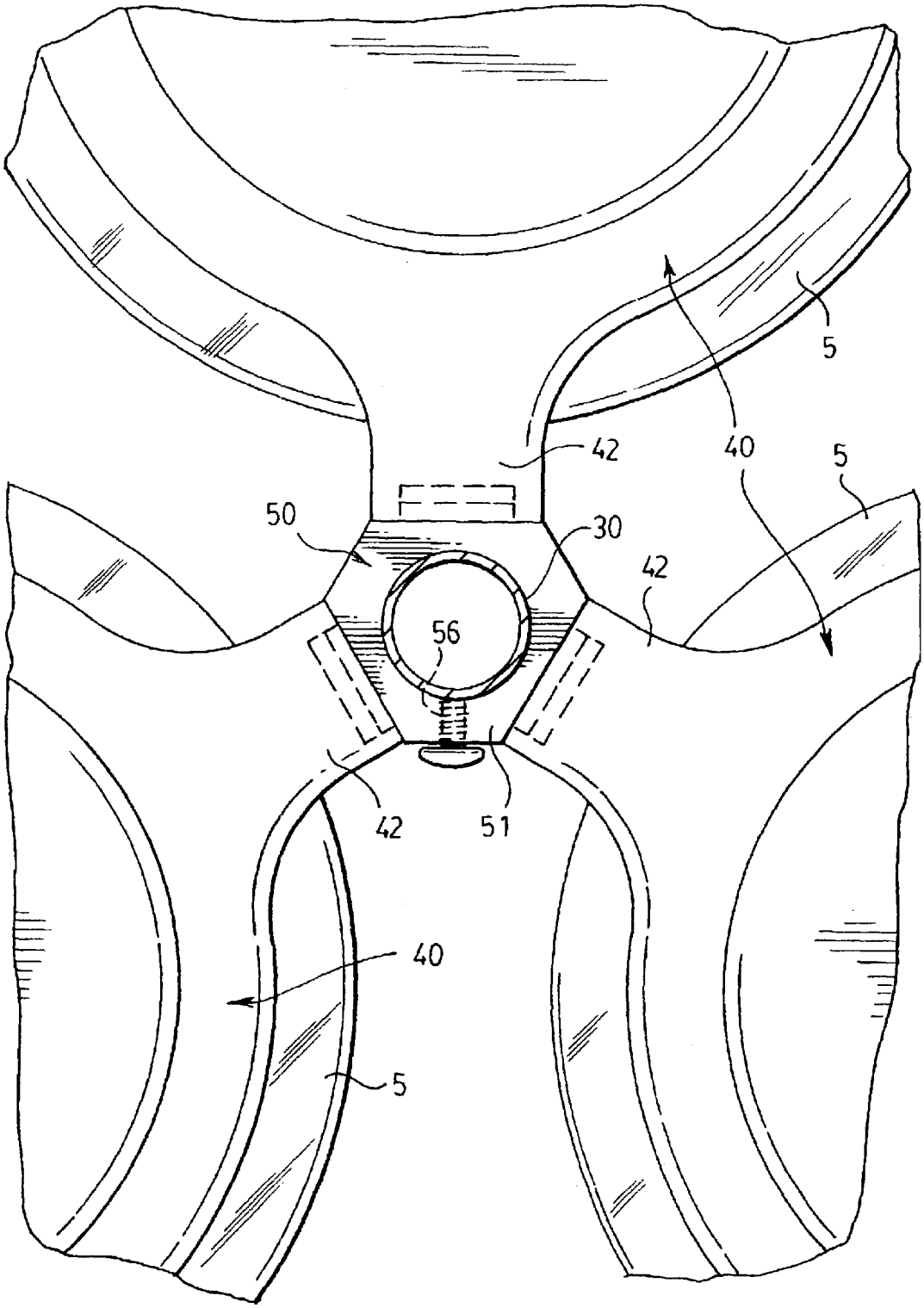
FIG. 2 is a partial top plan view of a further embodiment of vending machine island showing the engaging means affixing the vender lids to the securing post.
Figure 6:
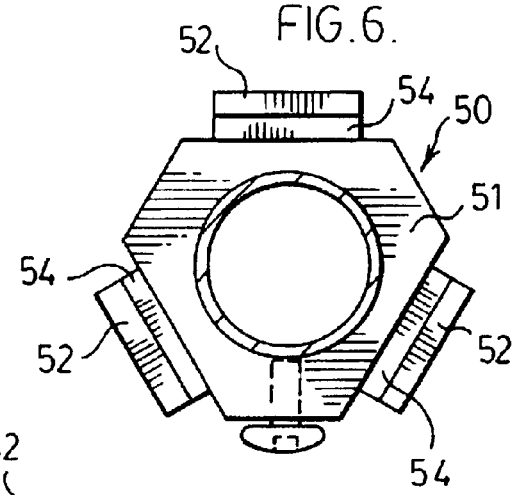
FIG. 6 is a top plan view of the engaging bracket of FIG. 5.

In the case of the island illustrated in FIG. 2, in which the tops of all three venders 2 are at the same level, a multi-channel bracket 50 such as that illustrated in FIG. 6 is placed over the post 30, with the screws 56, 60 in the release position (not protruding through the body 51). The hopper assembly is removed from a vender 2, and the base 7 is placed on and affixed (for example bolted) to one of the mounting sections, for example 26*a*. The hopper assembly is seated on the secure compartment and the lid 40 is placed on the globe 5 so that its flange 44 faces the securing post 30. The bracket 50 is slid up to the position where the flange 44 nests in one of the channels 54 of the bracket 50, and the setting screws 56 are tightened to hold the bracket 50 in the set position on the securing post.

Figure 8:
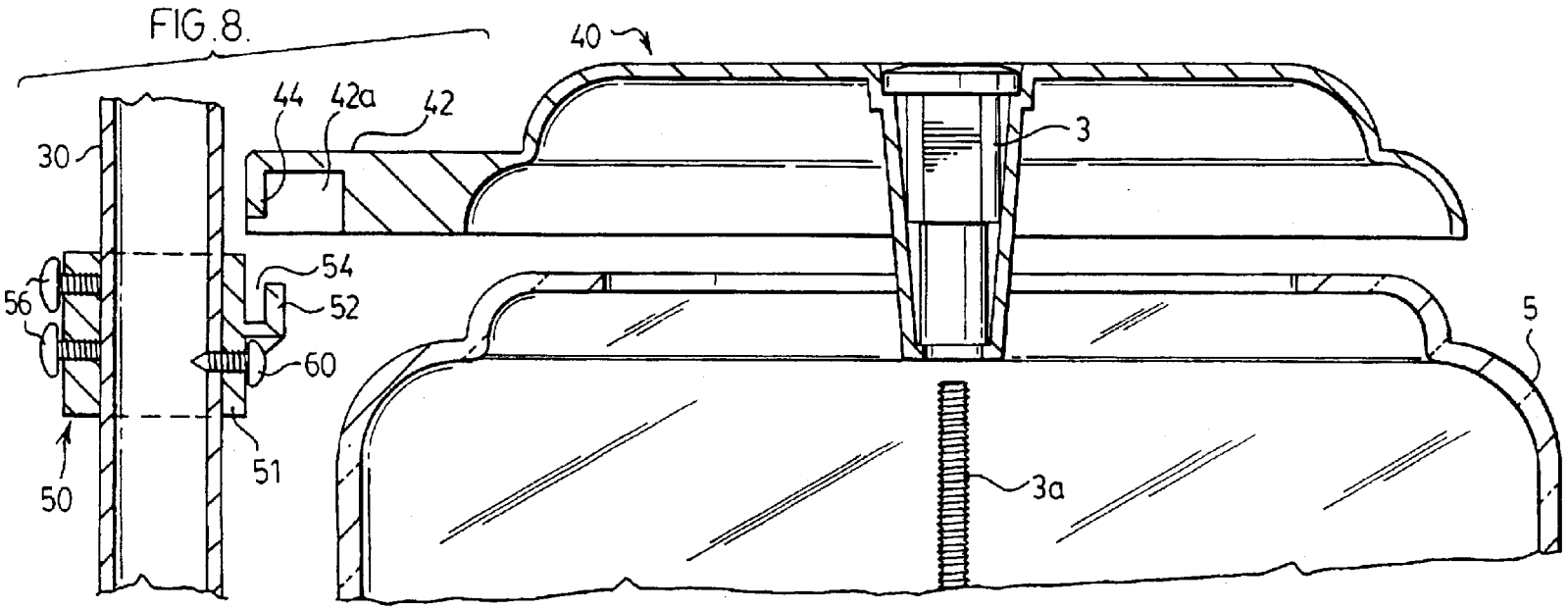
FIG. 8 is a cross-sectional elevation showing the lid before locking the lid to the vender.
Figure 9:
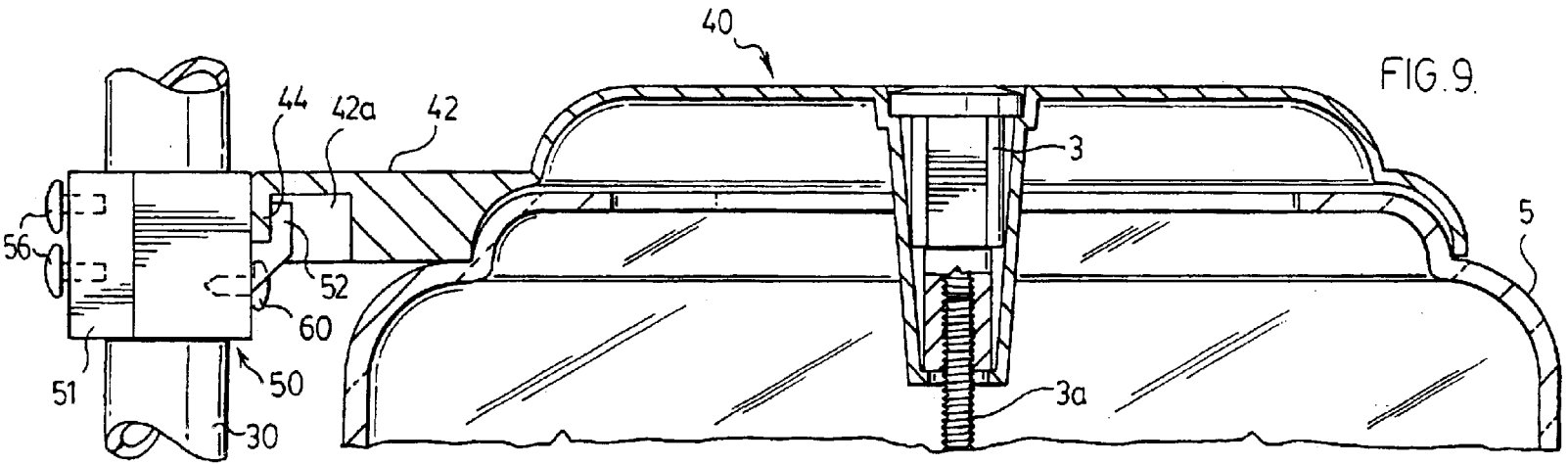
FIG. 9 is cross-sectional elevation showing the lid locked to the vender.

The lid 40 and hopper assembly are then removed from the vender 2. With the globe 5 removed, the locking screw 60 is then tightened, preferably to the point of punching through the securing post 30, as shown in FIG. 7, to lock the bracket 50 axially in the set position on the securing post 30. Venders 2 can then be mounted to the remaining two mounting sections 26*b* and 26*c* in like fashion, in each case by removing the hopper assembly, and affixing (e.g. bolting) the base 7 to the mounting plate 26. The hopper assembly is replaced over the secure compartment 4 of each vender 2, and the lid 40 is positioned over the globe 5 as shown in FIG. 8. As the lid 40 is lowered onto the globe 5, the flange 44 simultaneously engages the channel 54 of the bracket 50, as shown in FIG. 9. The lid 40 is locked to the center post 3*a* by tightening lock 3, with the flange 44 positioned within the channel 54. The extension 42 may have side walls 42*a*, as can be seen in FIG. 3, to ensure that the flange 44 is properly aligned within the channel 54.

With the lids 40 locked in position, the top of each vender 2 is secured to the securing post 30 by the engagement of the flange 44 by the channel 54. Thus, if a potential vandal or thief tries to wrest the vender from the stand, neither the base 7 nor the lid 40 can move laterally. Each vender 2 is thus effectively secured to the stand at both its top and bottom, which eliminates any leverage available to a potential vandal or thief. Moreover, in the embodiments illustrated the stability of each vender 2 is reinforced by the other venders 2, each of which absorbs components of any lateral force exerted on the first vender 2, to create a secure, integrated island formation.

In the embodiment where the tops of the venders 2 are not at the same level, as in FIG. 1, for each vender 2 a separate bracket 50 such as that illustrated in FIG. 4 is slid over the securing post 30. The venders 2 are seated on and affixed to their respective mounting section 26*a*, 26*b* or 26*c*, and one at a time each bracket 50 is temporarily set into position on the securing post 30 as described above, starting with the uppermost bracket 50 and finishing with the lowermost bracket 50. Once all three brackets 50 have been set in position and setting screws 56 tightened, the hopper assembly (or the entire vender 2 if desired) is removed from the mounting plate 26 and the locking screws 60 are tightened in the manner indicated above, to lock all brackets 50 in their set positions. The hopper assemblies are replaced on the venders 2, and the lids 40 are locked to the venders 2 and thus simultaneously engaged to the brackets 50, in the manner described above.

With the venders 2 mounted to the mounting plate 26 and the lids 40 locked to the venders 2 with their flanges 44 engaged into channels 54, the locking screws 60 are obstructed by the presence of the vender 2, and particularly the globe 5, as best seen in FIGS. 8 and 9. A potential vandal or thief therefore does not have sufficient clearance to insert a tool in order to release the locking screw 60, which is effectively inaccessible as long as the venders 2 are in place on the stand 20. The bracket(s) 50 can only be removed by first unlocking the lock 3, removing the lid 40 of any vender 2 blocking access to the locking screw 60, and then demounting either the hopper assembly or the entire vender 2 to gain access to the locking screw 60 so that the bracket 50 can be released and removed from the securing post 30.

The top of the securing post 30 may be closed by a decorative closure (not shown), or promotional signage (not shown) may be mounted on top of the securing post 30.

Various embodiments of the present invention having been thus described in detail by way of example, it will be apparent to those skilled in the art that variations and modifications may be made without departing from the invention. For example, the invention has been described and illustrated in the context of a vending machine island having a single mounting plate 26 mounted on a single standard 22, whereas it will be appreciated that the invention can equally be implemented in an island formed from separate standards 22 and mounting plates 26. The invention includes all such variations and modifications as fall within the scope of the appended claims.

I claim:

1. In a vending machine island comprising a plurality of vending machines, a securing system comprising:

a stand having a plurality of mourning positions defined by at least one mounting plate, for supporting the plurality of vending machines, each vending machine having a lockable lid, each lid having a first engaging member, a securing post disposed between the mounting positions and extending upwardly to at least a level of the lids of the plurality of vending machines, and at least one bracket secured to the securing post, having a second engaging member for engaging the first engaging member and securing the lid to the securing post, whereby when the vending machines are mounted to the at least one mounting plate and each lid is locked to a respective vending machine, the second engaging member cannot be disengaged from the first engaging member without unlocking the lid from the vending machine.

2. The securing system of claim 1 wherein the bracket comprises one of a flange or a slot and the lid comprises the other of the flange or the slot, and the second engaging member is engaged to the first engaging member when the flange is received in the slot.

3. The securing system of claim 2 wherein each lid is mounted to each respective vending machine with a generally downward motion, and the flange is received in the slot generally vertically.

4. The securing system of claim 1 wherein at least two of the lids of the vending machines are disposed at different levels when the vending machines are mounted to the at least one mounting plate, comprising a bracket secured to the securing post for each lid.

5. The securing system of claim 1 wherein the at least one bracket is secured to the securing post by at least one fastener disposed through a part of the bracket which is concealed by the lid after the lid is mounted.

6. The securing system of claim 4 wherein each bracket is secured to the securing post by at least one fastener disposed through a part of each bracket which is concealed by the mounted lids.

7. The securing system of claim 1 wherein the securing post is secured to the at least one mounting plate.

8. A vending machine island comprising:

a plurality of vending machines, each vending machine having a lockable lid, each lid having a first engaging member, a stand having a plurality of mounting positions defined by at least one mounting plate, for supporting the plurality of vending machines a securing post disposed between the mounting positions and extending upwardly, and at least one bracket secured to the securing post, having a second engaging member for engaging the first engaging member and securing the lid to the securing post, whereby when the vending machines are mounted to the at least one mounting plate and each lid is locked to a respective vending machine, the second engaging member cannot be disengaged from the first engaging member without unlocking the lid from the vending machine.

9. The vending machine island of claim 8 wherein the bracket comprises one of a flange or a slot and the lid comprises the other of the flange or the slot, and the second engaging member is engaged to the first engaging member when the flange is received in the slot.

10. The vending machine island of claim 9 wherein each lid is mounted to each respective vending machine with a generally downward motion, and the flange is received in the slot generally vertically.

11. The vending machine island of claim 8 wherein at least two of the lids of the vending machines are disposed at different levels when the vending machines are mounted to the at least one mounting plate, comprising a bracket secured to the securing post for each lid.

12. The vending machine island of claim 8 wherein the at least one bracket is secured to the securing post by at least one fastener disposed through a part of the bracket which is concealed by a mounted lid.

13. The vending machine island of claim 12 wherein each bracket is secured to the securing post by at least one fastener disposed through a part of each bracket which is concealed by the mounted lids.

14. The vending machine island of claim 8 wherein the securing post is secured to the at least one mounting plate.

15. A lockable lid for securing a vending machine to a vending machine island comprising a plurality of vending machines and a stand having a plurality of mounting positions defined by at least one mounting plate for supporting the plurality of vending machines, the island further comprising a securing post extending upwardly between the mounting positions and comprising at least one bracket comprising a first engaging member, the lockable lid comprising:

a second engaging member for engaging the first engaging member and securing the lid to the securing post, whereby when the vending machines arc mounted to the at least one mounting plate and the lid is locked to a vending machine, the second engaging member cannot be disengaged from the first engaging member without unlocking the lid from the vending machine.

16. The lockable lid of claim 15 wherein the bracket comprises one of a flange or a slot and the lid comprises the other or the flange or the slot, and the second engaging member is engaged to the first engaging member when the flange is received in the slot.

17. The lockable lid of claim 16 wherein each lid is mounted to each respective vending machine with a generally downward motion, and the flange is received in the slot generally vertically.

18. The lockable lid of claim 15 wherein at least two of the lids of the vending machines are disposed at different levels when the vending machines are mounted to the at least one mounting plate, comprising a bracket secured to the securing post for each lid.

19. The lockable lid of claim 15 wherein the at least one bracket is secured to the securing post by at least one fastener disposed through a part of the bracket which is concealed by a mounted lid.

20. The lockable lid of claim 19 wherein each bracket is secured to the securing post by at least one fastener disposed through a part of each bracket which is concealed by the mounted lids.

21. The lockable lid of claim 15 wherein the securing post is secured to the at least one mounting plate.

* * * * *